United States Patent [19]

Luy

[11] 4,316,172

[45] Feb. 16, 1982

[54] RESISTOR SUCH AS FOR DYNAMIC BRAKING OF ELECTRIC MOTORS

[75] Inventor: William R. Luy, Colgate, Wis.

[73] Assignee: Eaton Corporation, Cleveland, Ohio

[21] Appl. No.: 162,964

[22] Filed: Jun. 25, 1980

[51] Int. Cl.[3] ..... H01C 3/00

[52] U.S. Cl. ..... 338/280; 338/295; 338/315; 338/318

[58] Field of Search ..... 338/51, 58, 280, 290, 338/295, 315-318

[56] References Cited

U.S. PATENT DOCUMENTS

| | | | |
|---|---|---|---|
| 2,680,178 | 6/1954 | Kuhn et al. | 338/58 |
| 2,858,402 | 10/1958 | Griffes et al. | 338/58 |
| 2,874,257 | 2/1957 | Kuhn et al. | 338/58 |
| 4,051,452 | 9/1977 | Luy | 338/51 |

*Primary Examiner*—C. L. Albritton

*Attorney, Agent, or Firm*—R. J. McCloskey; W. A. Autio

[57] ABSTRACT

A dynamic braking resistor as shown and claimed in U.S. Pat. No. 2,680,178 in which the insulator blocks (226) in this new disclosure are formed of a hot-molded organic compound instead of steatite or asbestos. This allows the insulator blocks to be securely mounted to the frame (210, 212), and allows the elimination of the springs, spring cups and pressure plate. In addition, the extra insulative mica sheet required by the above patent is eliminated without loss of protection from short circuits. However, in order to protect the insulator blocks from the heat generated by the resistor ribbons (218, 220), the support clips (232) are made longer to allow more expansion of the ribbons and to hold the ribbons further away from the insulator blocks. In an alternative embodiment, three resistor ribbons (234, 236, 238) are employed, and each support clip (240) supports one reflex bend of all three ribbons.

2 Claims, 7 Drawing Figures

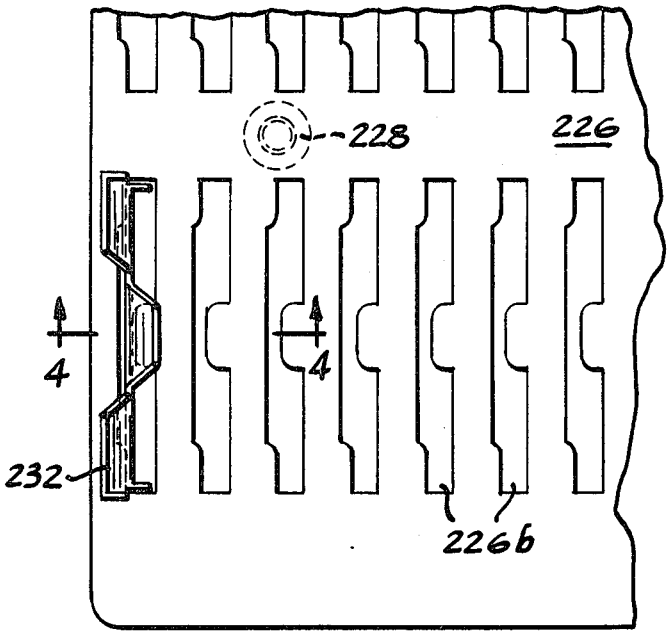
Fig. 3
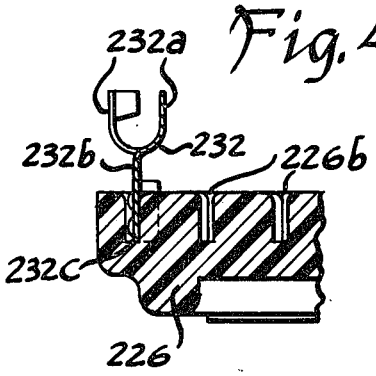
Fig. 4
Fig. 5
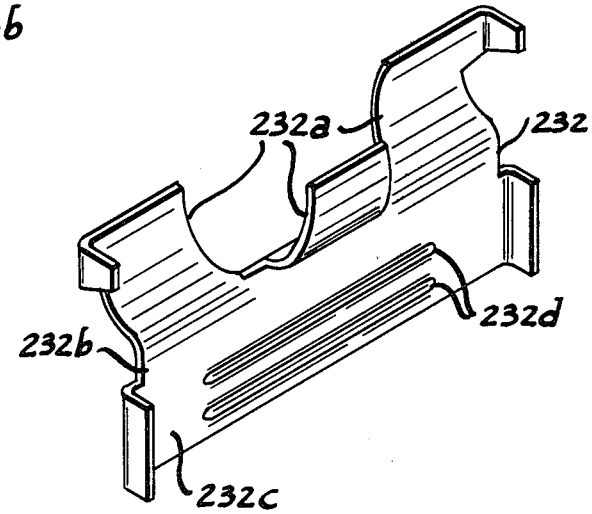

RESISTOR SUCH AS FOR DYNAMIC BRAKING OF ELECTRIC MOTORS

BACKGROUND OF THE INVENTION

This invention relates to resistors used in the dynamic braking function of electric motor systems such as those found in railroad locomotives, and in particular to a simplification and reduction of parts in those resistors without adversely affecting performance.

A widely used example of a dynamic braking locomotive resistor is disclosed in Kuhn et al U.S. Pat. No. 2,874,257. As shown there, however, this resistor is extremely complex, having many parts, including spring loaded insulator blocks and extra layers of insulation.

In other examples of such resistors, the insulator blocks have been formed of cold molded inorganic materials such as asbestos cement. That material has become more difficult to obtain with the advent of strict Federal regulations regarding asbestos. Thus it would be desirable to use a different material to form those insulator blocks.

SUMMARY OF THE INVENTION

This invention involves a dynamic braking resistor such as for a locomotive, having reflexed resistance ribbon elements being supported by clips which are in turn anchored in insulator blocks formed of a hot molded organic material. Since these blocks are superior both mechanically and electrically to the asbestos blocks used in known resistors, the extra layers of mica insulation can be eliminated, and the blocks can be bolted to the frame, obviating the springs and associated parts which compressively loaded the insulator blocks of known resistors. Since the insulator blocks are somewhat susceptible to heat damage, however, the support clips hold the heated ribbons at sufficient distances to protect the blocks.

One object of this invention is to provide an improved dynamic braking resistor which is simpler, having fewer parts than known resistors.

A more specific object of the invention is to provide a resistor as described above having insulator blocks which are formed of hot molded organic material, which insulates better from mechanical shock as well as from electrical short.

Another specific object of the invention is to provide a resistor as described above having resistor ribbons which are supported by clips in order to protect the insulator blocks from the heat generated by the ribbons.

Other objects and advantages of this invention will appear hereinafter.

DESCRIPTION OF THE DRAWINGS

FIG. 3 is an enlarged view of a portion of one of the insulator blocks shown in FIGS. 1 and 2.

FIG. 4 is a fragmentary cross-sectional view of FIG. 3 taken along line 4—4.

FIG. 5 is an enlarged isometric view of a clip for supporting the resistance ribbon of the resistor.

DESCRIPTION OF THE PREFERRED EMBODIMENTS

Figure 1:
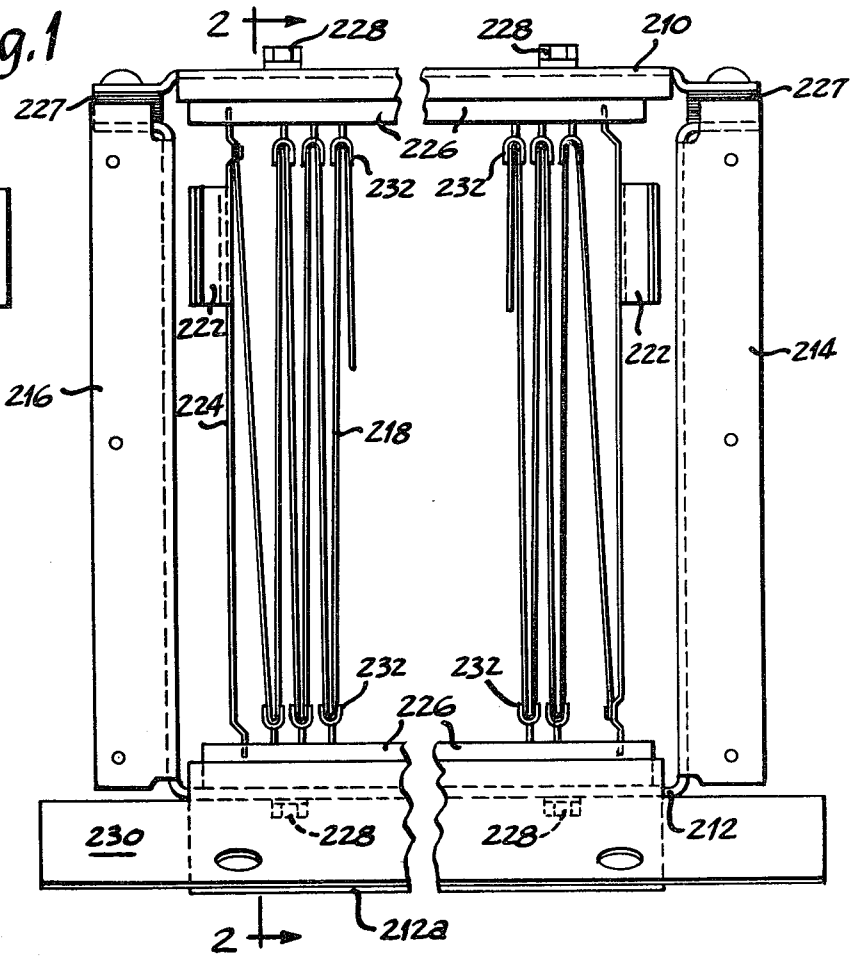
FIG. 1 is a front view of a resistor embodying the invention.
Figure 2:
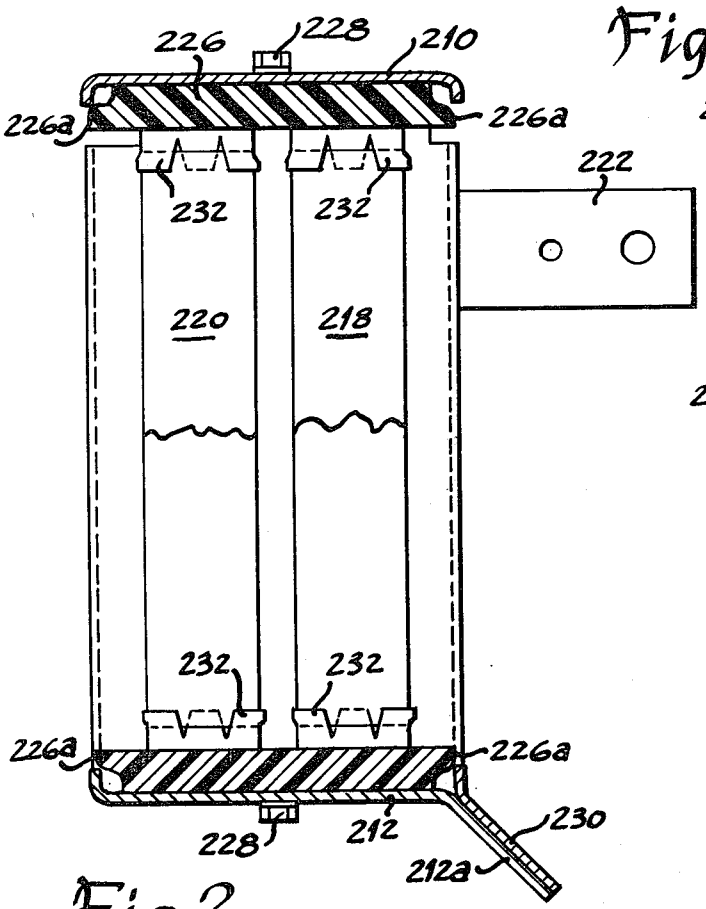
FIG. 2 is a cross-sectional view of FIG. 1 taken along line 2—2, showing a resistor having two resistive ribbons.

The structure and function of the basic components of the resistor shown and described in U.S. Pat. No. 2,680,178 are incorporated herein by reference and are not described except as modified and described hereinafter. Such basic components, as shown in FIGS. 1 and 2, include: (1) end frame members 210 and 212; (2) side frame members 214 and 216; (3) resistance ribbons 218 and 220; (4) terminal plates 222 and 224; (5) insulator blocks 226; and (6) shims 227.

Insulator blocks 226, however, are not formed of asbestos or steatite, as in the example given in said patent, but rather of a hot-molded organic material which is superior mechanically and electrically. This mechanical superiority allows the elimination of spring cups 28, springs 30, and pressure plate 32 of said patent, since the insulator blocks are now secured to end frame members 210 and 212 by means such as threaded fasteners 228. The mechanical and electrical superiority of this insulator material allows for the elimination of the mica sheet 40 of said patent. In addition, the shape of insulator blocks 226 provide further protection from short circuiting by means of ridges **226*a* shown in cross-section in FIG. 2**.

A flange portion **212*a* of end frame member 212 and a flange 230** have been added to facilitate mounting of the resistor.

In order to support the resistor elements 218 and 220 with respect to the insulator blocks 226 and the frame members, clips 232 are employed. These clips are somewhat similar in structure and function to those shown in Kuhn et al U.S. Pat. No. 2,874,257, FIGS. 7, 8 and 11-15, and described at Col. 3, lines 17-51 which is hereby incorporated by reference. Loop supporting arms **232*a* are made long, to allow resistance ribbons 218 and 220 more room to expand while improving ribbon retention within the clip. Further, support portion 232*b* is also made long so that the ribbons, and the heat they generate when current is passed through them, is held away from the insulator blocks 226 to prevent heat damage and allow air to circulate between the ribbons and the insulator blocks. Finally, lower mounting portion 232*c* has also been made long and has been given a pair of reinforcing ribs 232*d*, in order to give sufficient support to the enlarged upper portions of clip 232** described above.

Figure 6:
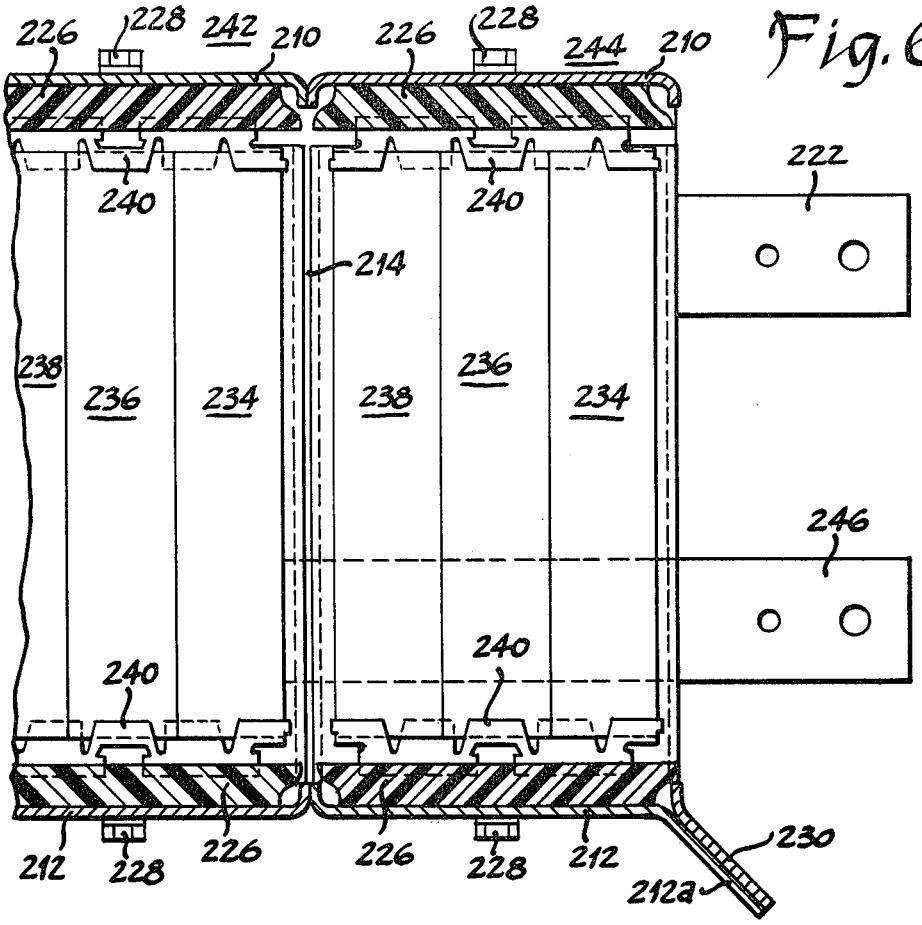
FIG. 6 is a view similar to FIG. 2, showing an alternative embodiment wherein the resistor has three ribbons and wherein two such resistors are in tandem.
Figure 7:
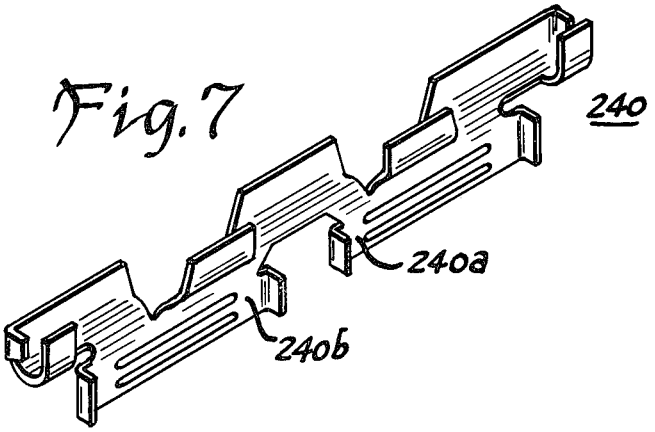
FIG. 7 is an enlarged isometric view of a clip used to support the three ribbons of the embodiment shown in FIG. 6.

FIGS. 6 and 7 illustrate an alternative embodiment of this resistor, having three resistance ribbons 234, 236, and 238, each of which is slightly narrower than the ribbons described above. This allows the use of the identical frame and associated parts, including insulator blocks 226. Clip 240, however, has been modified so that each clip holds one reflex of all three ribbons, whereas clip 232 holds only one ribbon. In addition, clip 240 has two lower mounting portions **240*a* and 240*b* which fit into the two slots 226*b* in insulator block 226, while each clip 232 fits into one such slot. Similar to clip 232, clip 240 has been made vertically longer to protect blocks 226** from the heat generator by the ribbons, to allow more expansion, and to improve ribbon retention.

The determination as to whether to use a three-ribbon version in place of the two-ribbon design is made inter alia on the basis of the amount of energy to be dissipated in the particular braking operation under consideration. Regardless of the number of ribbons used in the resistor, however, the resistors are normally applied in tandem as shown in FIG. 6, with rear resistor assembly 242 being attached to front resistor assembly 244 by suitable means, and being attached to an electrical circuit by terminals 246.

While the apparatus hereinbefore described is effectively adapted to fulfill the aforesaid objects, it is to be understood that the invention is not intended to be confined to the particular preferred embodiment herein set forth, inasmuch as it is susceptible of various modifications without departing from the scope of the appended claims.

What is claimed is:

1. A resistor, such as for use in dynamic braking of electrical motors, comprising in combination:

a pair of supporting frames each having two end frame members and two side frame members connected together, said end frame members being parallel to each other;

like insulating blocks formed of hot-molded organic material immovably secured directly to the opposing faces of said end frame members;

a layer of continuous reflexed resistance ribbon comprising segments running from one of said opposing faces to the other, said segments connected by reflexes in proximity to but separated from said insulating blocks in each of said frames;

support clips between said insulating blocks and said reflexes for providing individual support to each of said reflexes and holding said ribbon within the space defined by said supporting frame;

terminal means connected to said ribbon for connecting the latter to a source of electric current;

flanges on said side frame member through which said pair of frames are rigidly secured to one another so that said end frame members of the respective frames are in abutting relation;

and lateral ridges on said insulating blocks overlying the edges of the associated end frame members to prevent conductive material from being lodged therein and short-circuiting said resistor ribbon to said end frame member, and said ridges on the insulating blocks of adjacent connected frames being in close proximity to one another to prevent conductive material from falling therebetween into short-circuiting contact with said end frame members.

2. A resistor as recited in claim 1 comprising:

a second and a third layer of continuous reflexed resistance ribbon each also having segments running from one to the other of said opposing faces and connected to each other by reflexes in proximity to said insulating blocks;

two rows of slots in said insulating blocks for mounting said support clips;

and said support clips comprising a selected one of two interchangeable support clips including (a) a single ribbon support clip mounted in each slot in said two rows of slots between said insulating blocks and said reflexes of the first and second ribbon for providing individual support to each of their reflexes and holding said first and second ribbons in first and second layers within the space defined by said supporting frame, and (b) a triple support clip mounted in each pair of slots in a block which includes adjacent slots of the two rows thereof for providing support to reflexes of three ribbons and holding said three ribbons in three layers within the space defined by said supporting frame; and terminal means connected to said second and third ribbons for connecting said second and third ribbons to a source of electric current.

* * * * *